United States Patent [19]

Richard

[11] Patent Number: 4,620,400

[45] Date of Patent: Nov. 4, 1986

[54] PRESTRESSED CONCRETE STRUCTURE, A METHOD OF PRODUCING THIS STRUCTURE, AND ELEMENTS FOR IMPLEMENTING THE METHOD

[75] Inventor: Pierre Richard, Neuilly S. Seine, France

[73] Assignee: Bouygues, France

[21] Appl. No.: 654,531

[22] Filed: Sep. 25, 1984

Related U.S. Application Data

[63] Continuation of Ser. No. 324,015, Nov. 23, 1981.

[30] Foreign Application Priority Data

Nov. 25, 1980 [FR] France ..... 80 24984

[51] Int. Cl.[4] ..... E04C 3/20

[52] U.S. Cl. ..... 52/227; 52/223 R; 14/3; 14/73

[58] Field of Search ..... 14/3, 10, 17, 73; 52/228, 223 L, 227, 223 R, 650

[56] References Cited

U.S. PATENT DOCUMENTS

| | | | |
|---|---|---|---|
| 183,291 | 10/1876 | Foster | 14/17 |
| 948,215 | 2/1910 | Fitzpatrick | 52/227 |
| 1,874,572 | 8/1932 | Montgomery | 52/227 |
| 2,053,135 | 9/1936 | Palton | 14/73 |
| 2,101,538 | 12/1937 | Faber | 52/227 |
| 2,925,727 | 2/1960 | Harris et al. | 52/227 |
| 3,103,025 | 9/1963 | Gassner et al. | 14/73 |
| 3,156,018 | 11/1964 | Slayter | 52/227 |
| 3,257,764 | 6/1966 | Cripe | 52/223 R |
| 3,561,178 | 2/1971 | Finsterwalder et al. | 14/19 |
| 3,794,433 | 2/1974 | Schupack | 52/223 R |
| 4,006,523 | 2/1977 | Mau Quoy | 52/223 R |
| 4,200,946 | 5/1980 | Lawrence | 14/17 |
| 4,282,619 | 8/1981 | Rooney | 14/17 |

FOREIGN PATENT DOCUMENTS

| | | | |
|---|---|---|---|
| 566546 | 4/1958 | Belgium | 14/73 |
| 3110937 | 12/1981 | Fed. Rep. of Germany | 14/3 |
| 503513 | 5/1920 | France | 52/227 |
| 60490 | 8/1947 | Netherlands | 52/228 |
| 338864 | 11/1930 | United Kingdom | 52/223 L |
| 12242 | 6/1948 | United Kingdom | 14/3 |
| 984683 | 3/1965 | United Kingdom | 14/73 |
| 1033581 | 6/1966 | United Kingdom | 14/73 |
| 426023 | 10/1974 | U.S.S.R. | 52/223 R |

OTHER PUBLICATIONS

"Launching a Concrete Bridge Saves $200,000", Concrete International; Apr. 1979.

*Primary Examiner*—Carl D. Friedman
*Assistant Examiner*—Michael Safavi
*Attorney, Agent, or Firm*—McCormick, Paulding and Huber

[57] ABSTRACT

This invention relates to a prestressed concrete structure which behaves like a hollowed out slab.

The structure combines a lattice work structure and a prestress by external cable, maximally optimizing the advantages of these two techniques. The Figure represents a part of the floor of a bridge according to the present invention. The floor comprises two tables 6 and 7 which are joined by a lattice work composed of pyramids P. Prestressing cables 8, 8' and 9' pass between the tables outside the concrete of the bars of the pyramids.

The present invention is used for the construction of bridges, roofings and floors.

16 Claims, 17 Drawing Figures

PRESTRESSED CONCRETE STRUCTURE, A METHOD OF PRODUCING THIS STRUCTURE, AND ELEMENTS FOR IMPLEMENTING THE METHOD

This is a continuation of application Ser. No. 324,015, filed Nov. 23, 1981.

The structure of the present invention comprises two reinforced or prestressed concrete slabs which are positioned opposite each other and are connected by a lattice work of reinforced or prestressed concrete positioned in the volume between the slabs, the lattice work being composed of prefabricated elements comprising at least one group of at least two bars and at least one cross piece which are positioned along the three sides of a triangle, the meeting point of the two bars forming the apex of the triangle, general prestressing cables of the structure being anchored at their ends in concrete solid masses positioned between the two slabs and integral with at least one of the slabs, the said cables passing inside said volume and/or in the vicinity of the slabs and remaining outside the concrete of the lattice work.

Among all the productions of a structure of this type, those are preferred which have one or more of the following characteristics:

- the lattice work forms pyramids,
- the lattice work is composed of bars or slabs,
- the concrete which is in a section of said volume between the slabs by a median plane which is substantially parallel to the slabs is provided to at least 50% by bars of the lattice work,
- the lattice work is composed of rigid prefabricated elements comprising at least one group of at least two bars and at least one cross piece, the two bars and the cross piece being positioned along the three sides of a triangle, and
- at the intersections of the lattice work and the slabs, the slabs comprise nodes, at least some of which have grooves for guiding and/or deflecting the prestressing cables of the structure.

The present invention also relates to a method of producing a structure of this type from these lattice work elements.

According to this invention, at least one slab is prefabricated, comprising its own reserves for each receiving a meeting point of two bars of a lattice work element, prefabricated lattice work elements are positioned on the slab so that the selected meeting points are positioned in the reserves, concrete is cast into the reserves around said points to produce nodes and to join the slab and the lattice work elements into a rigid movable unit.

According to another aspect of this invention, some of the cross pieces of the lattice work elements are used to produce the difficult part of the casing of the other slab of the structure, and it is possible to produce the rest of the casing using casings which are simply slid between the lattice work elements parallel to the length of the construction.

Some of the cross pieces of the lattice work elements typically follow one another, forming a line which extends over a part or over all of the length of a slab which possibly comprises places where two cross pieces are joined and which possibly meet other lines.

A use of the present invention for the construction of a bay of a bridge will now be described in the following, referring to the Figures of the accompanying drawing.

In the above description of the Figures, the terms "longitudinal" and "cross" respectively mean along the length and along the width of the bridge.

Figure 1:
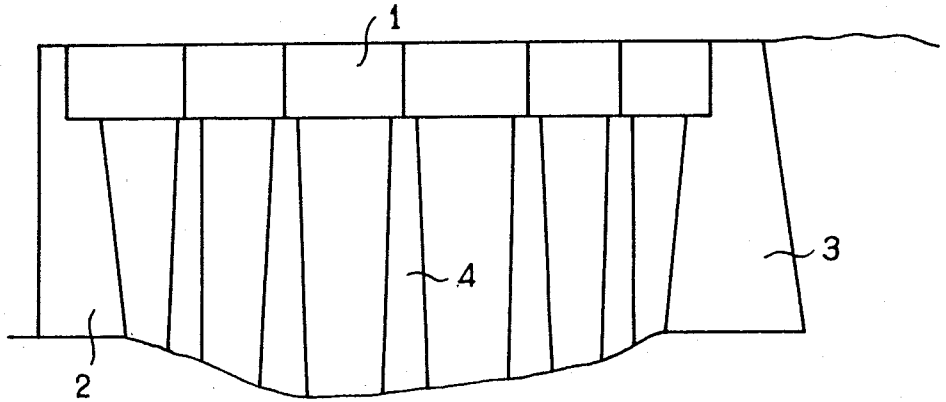
FIG. 1 is a schematic longitudinal view of the bridge.

The bridge which is simplified in FIG. 1 comprises in a manner known per se a floor composed of successive bays 1 and resting on end abutments 2 and 3 and on intermediate piers 4.

The present invention primarily relates to the structure of the floor of the bridge and in the following, a current bay of the floor will be described by way of example.

This bay 2 which is established between two successive piers comprises a solid mass at each end. The floor of the bay is composed of two slabs or "tables" of reinforced or prestressed concrete, respectively lower and upper tables, connected by a concrete triangulation.

The assembly is prestressed by cables which pass from one solid mass to the other while passing into the volume of the triangulation, but outside the concrete of the triangulation, and below the concrete of the lower table due to passages which are provided for this purpose.

Figure 2:
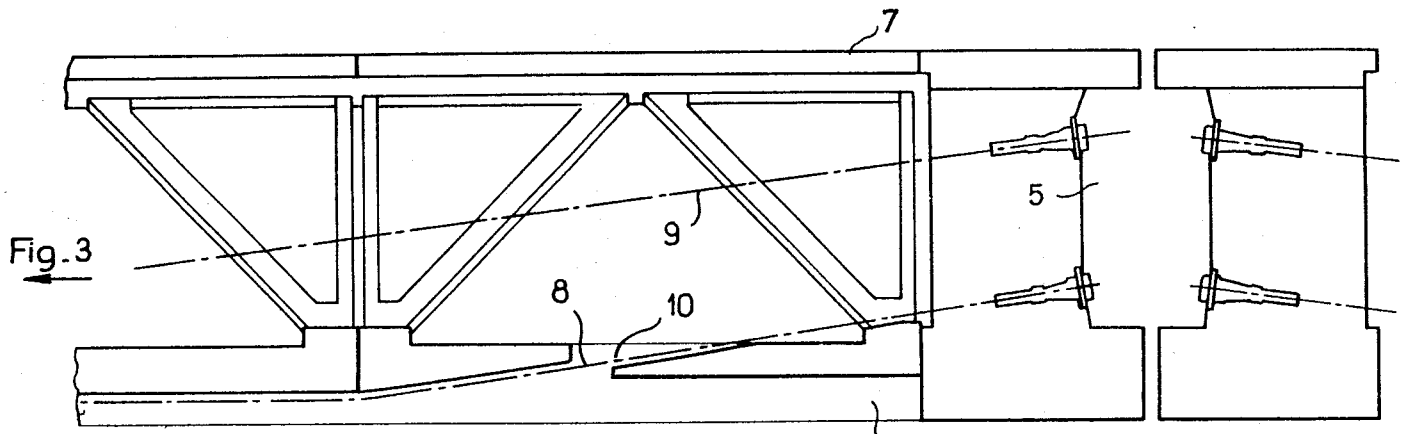
FIGS. 2 to 5 are longitudinal sections of the floor of a current bay of the bridge at different points positioned at intervals along the length of the bay.

FIG. 2 is a longitudinal section of the bay in the region of the front end thereof. This Figure illustrates the front solid mass 5 of the bay situated between the two tables 6 and 7 and being integral therewith. The Figure also illustrates two prestressing cables 8 and 9 which rest on the solid mass 5. The cable 8 at its exit from the solid mass passes into the volume of the triangulation, then into a passage 10 which is made in the lower table 6. It then undergoes a deflection, then passes straight along the table 6. Later on, it will be deflected in the opposite direction, will re-ascend into the volume occupied by the triangulation, then it will terminate at the solid mass which is located at the other end of the bay.

Figure 3:
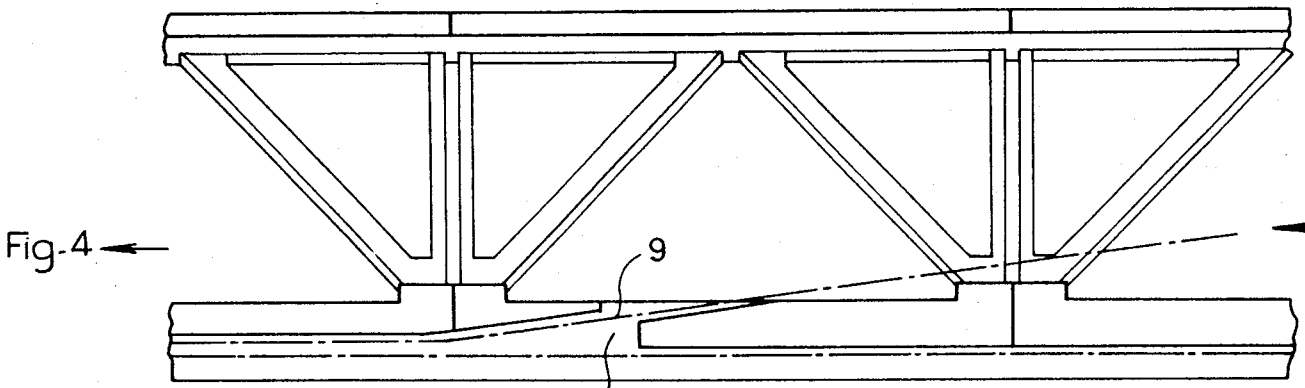

FIG. 3 is a longitudinal section of the floor at a point where the cable 9, for its part, passes through a passage 11 in the lower table, then passes straight along the table.

Figure 4:
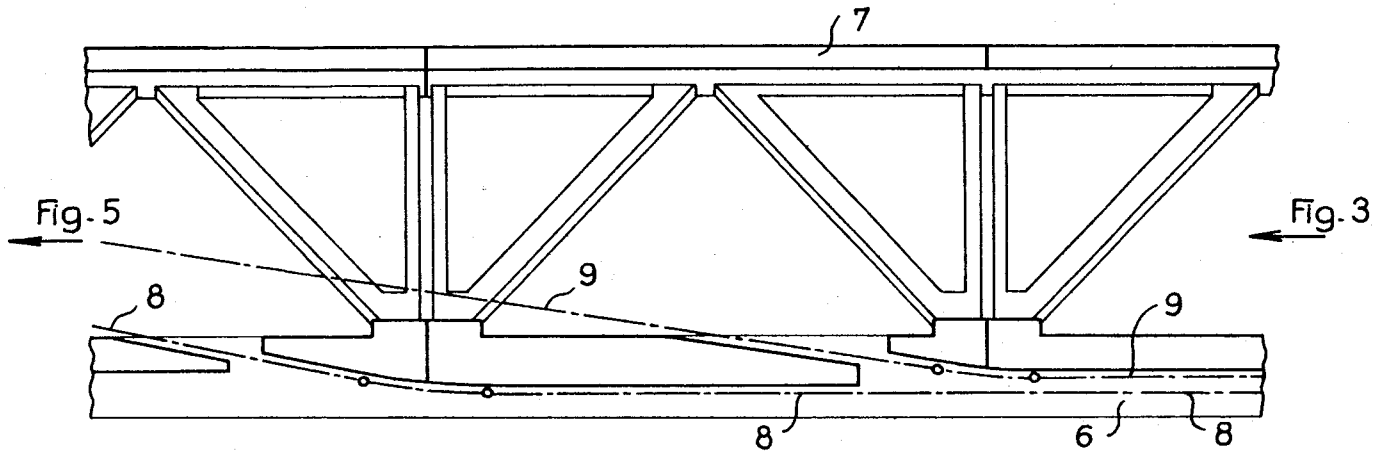

FIG. 4 is a longitudinal section of the floor at another point where the two cables 8 and 9 re-ascend into the triangulation volume. Finally, FIG. 5 is a longitudinal section of the other end (or rear end) of the bay which shows the other solid mass 12 situated between the tables and being integral therewith.

Figure 8:
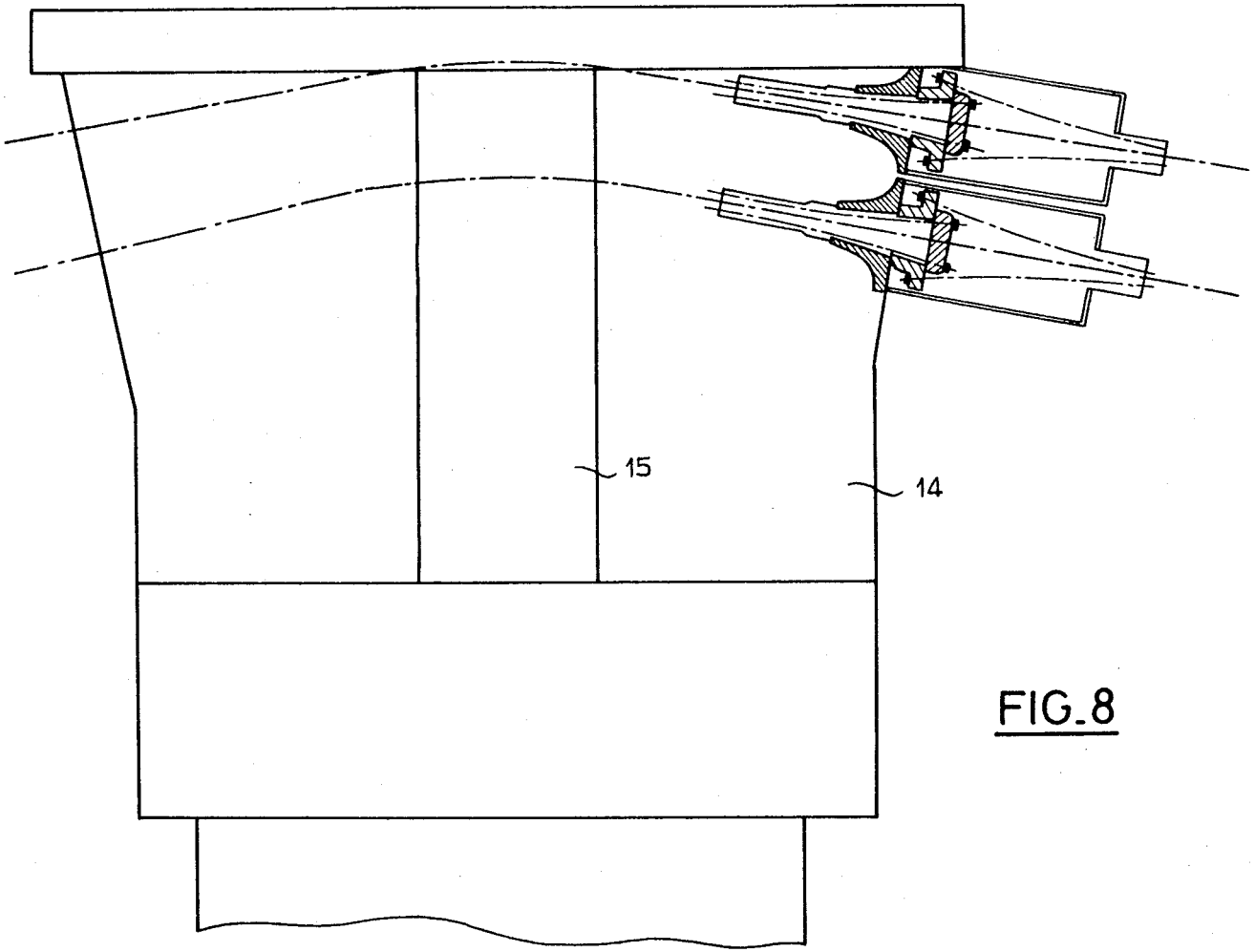

The cables 8 and 9 terminate at this solid mass, as may best be seen in FIG. 8.

Figure 5:
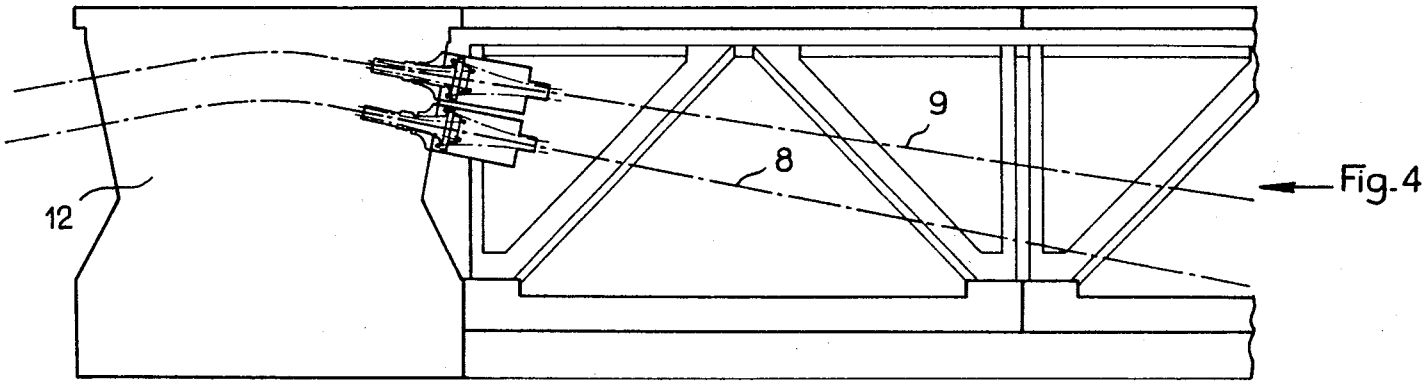

In fact, according to a characteristic of the present invention, a solid mass such as the mass 12 may play a three-fold part;

- to provisionally ensure the anchoring of the prestressing cables (such as 8 and 9) during the construction of the bridge (a part which will later be withdrawn from it),
- to deflect the prestressing cables from one bay to another (as illustrated in FIG. 5), and
- to transmit to the pier on which it is located its own loads and the working loads of bays adjacent to the pier.

It should be noted that although the solid masses are generally positioned opposite the piers, they may also be positioned in a different location.

It is assumed in FIG. 2 that the front end of the bay is positioned at the level of an expansion joint of the bridge. This is optional.

Figure 6:
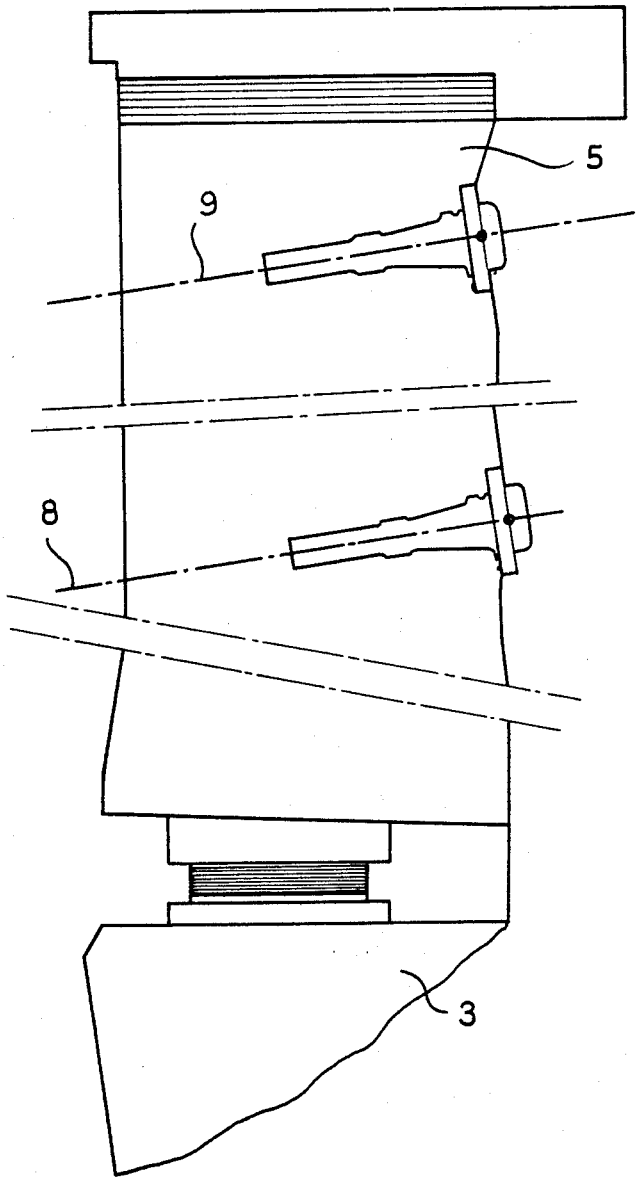
FIG. 6 is a longitudinal section in the region of the front abutment of the bridge.

Solid anchoring masses are usually provided on the end abutments of the bridge. FIG. 6 illustrates as an example a solid anchoring mass 5 on the abutment 3 of the front end of the bridge.

Figure 7:
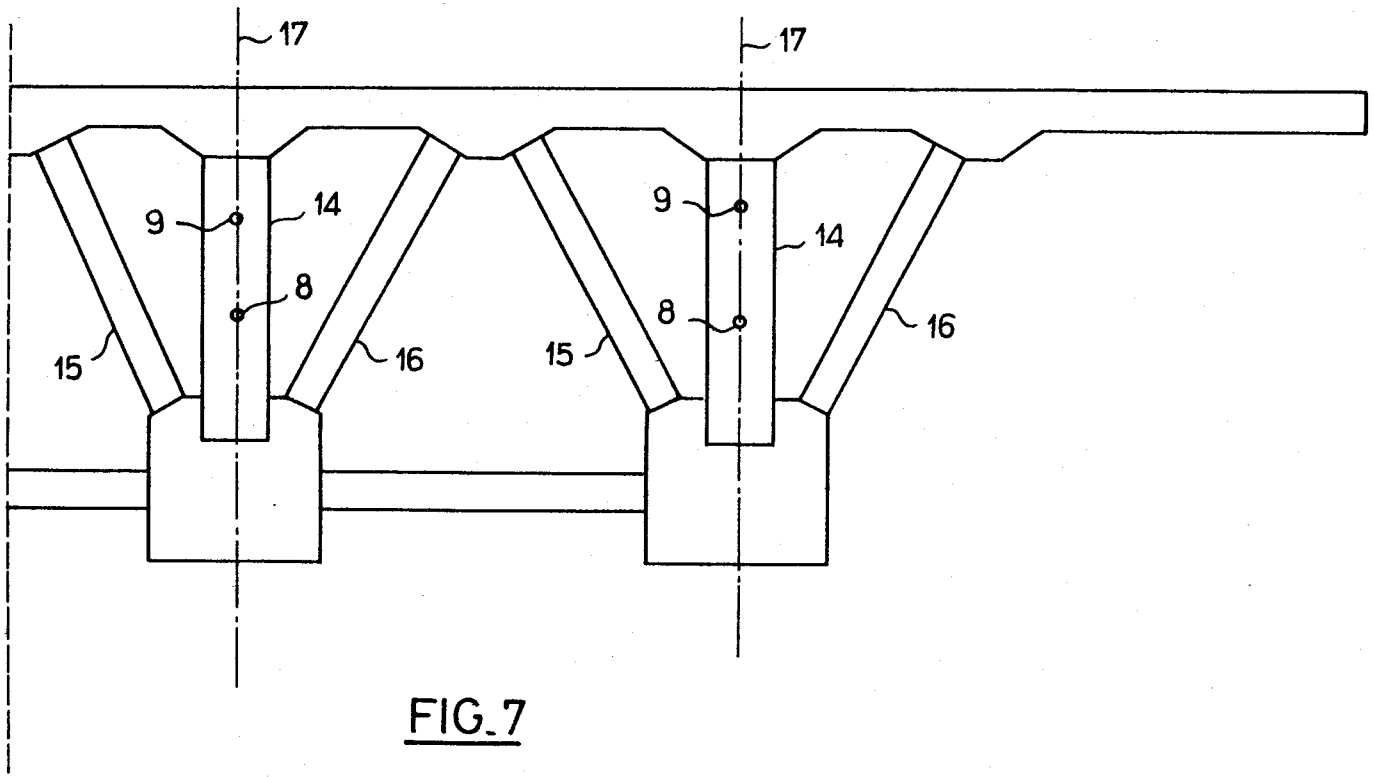
FIGS. 7 and 8 are respectively cross and longitudinal sections of a solid anchoring mass of the prestressing cables.

According to another characteristic of the present invention, at least some of the solid anchoring masses or masses for the passage of the prestressing cables are preferably and substantially composed of concrete slabs or wings, as is most clearly illustrated in FIG. 7 which is a semi-cross section of a solid mass, such as 12. The solid mass is composed of several sections which each comprise a centre vertical slab or wing 14 and lateral oblique slabs or wings 15 and 16, the three wings or slabs being positioned in a goose-foot shape.

In FIG. 8 which is a longitudinal section of the solid mass, the area of the centre wing 14 is clearly greater than that of the lateral wings. The prestressing cables pass into or are anchored in the centre wing 14. The plane of the passage of the cables is designated by reference number 17 in FIG. 7. The solid masses on the abutments have a similar structure.

Another object of the present invention is to provide a particular embodiment of the triangulation.

According to this invention, the triangulation is preferably a structure composed of concrete bars which may have a small cross section, because the prestressing cables pass outside the concrete of the bars.

The bars typically meet the tables at points or "nodes", the shapes of which are designed for deflecting the prestressing cables, as required.

Figure 9:
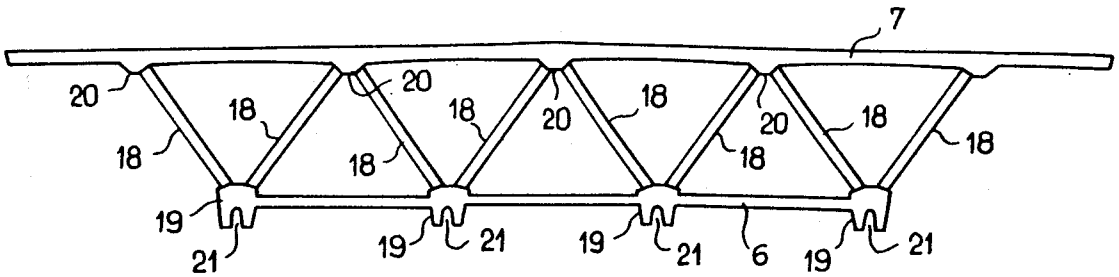
FIG. 9 is a current cross section of the floor.

FIG. 9 which is a current cross section of the floor (or, in other words: a section along the length of a voussoir) illustrates the bars 18 of the triangulation which terminate at nodes 19 in the lower table 6 and at nodes 20 in the upper table 7. Some of the nodes have grooves 21, inside which the prestressing cables may pass, such as cables 8 and 9.

As necessary, the tables have ribs which present passages co-operating with the grooves of the nodes for guiding and deflecting the prestressing cables, either along the table or across the table.

Figure 11:
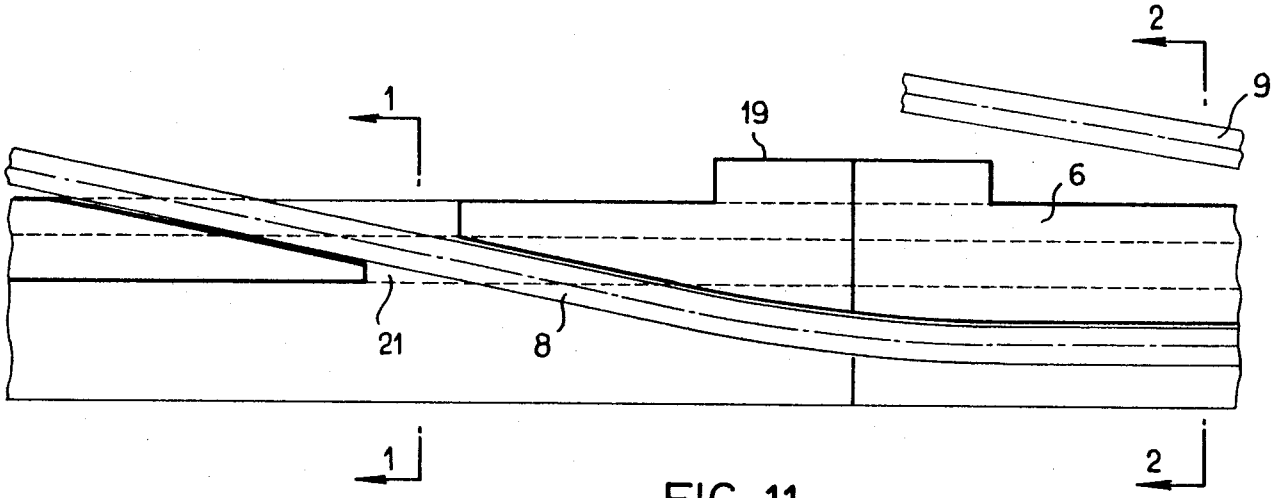
FIGS. 10 and 11 are longitudinal vertical sections of the current lower table of the floor of a bay at two points of this table.
Figure 10:
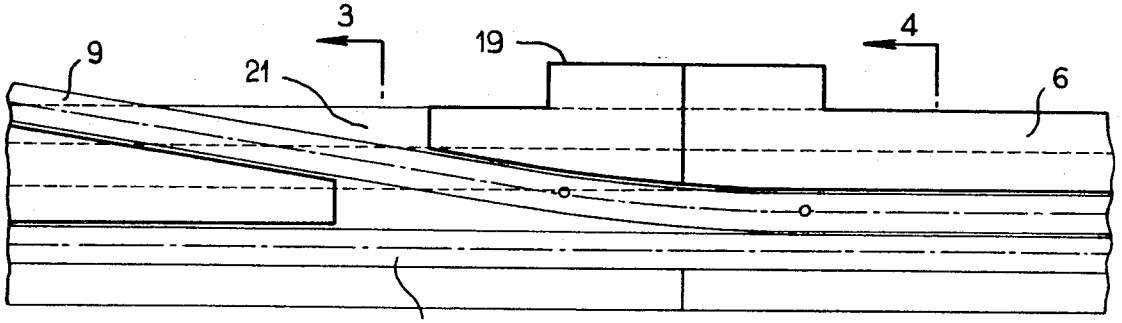
Figure 12:
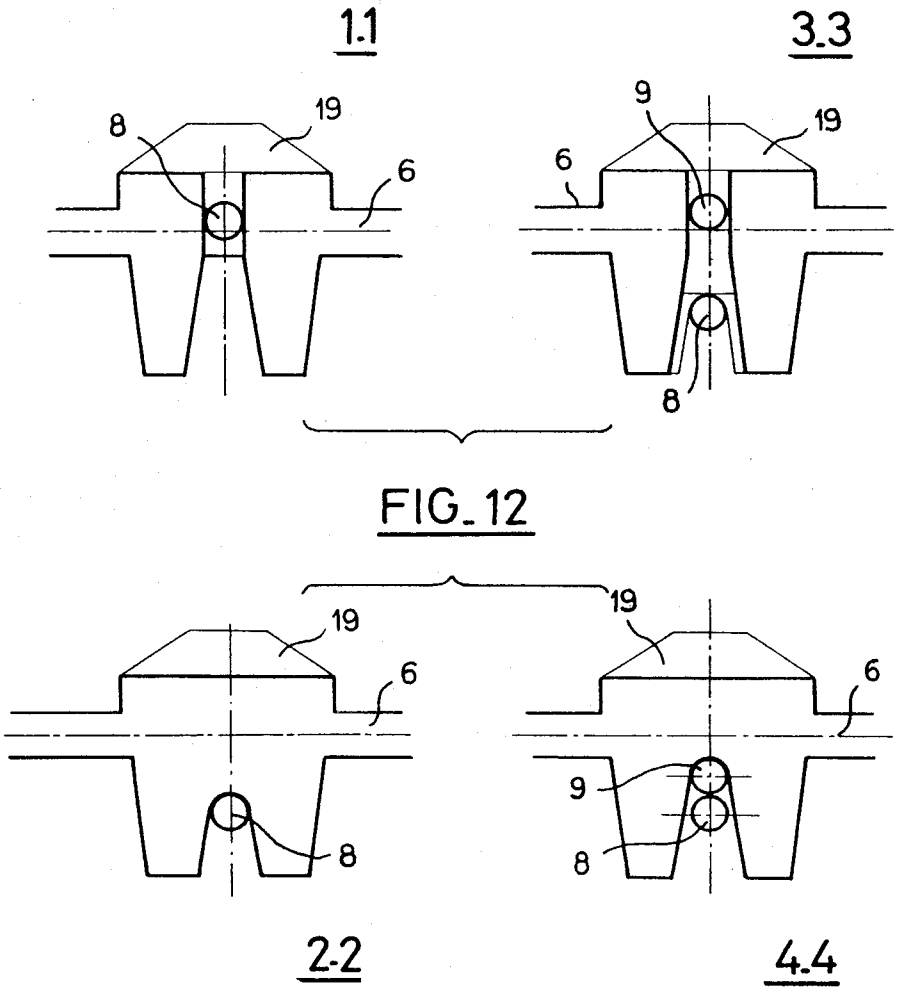
FIG. 12 illustrates vertical cross sections of the lower table of FIGS. 10 and 11 at different points of the table.

These arrangements are already illustrated in Figures 2 to 5, but they are much clearer in FIGS. 10 and 11 which are longitudinal vertical sections of the lower table at two successive locations, and in FIG. 12 which illustrates vertical cross sections of these locations.

The bars of the triangulation have been omitted in FIGS. 10 and 11.

Figure 13:
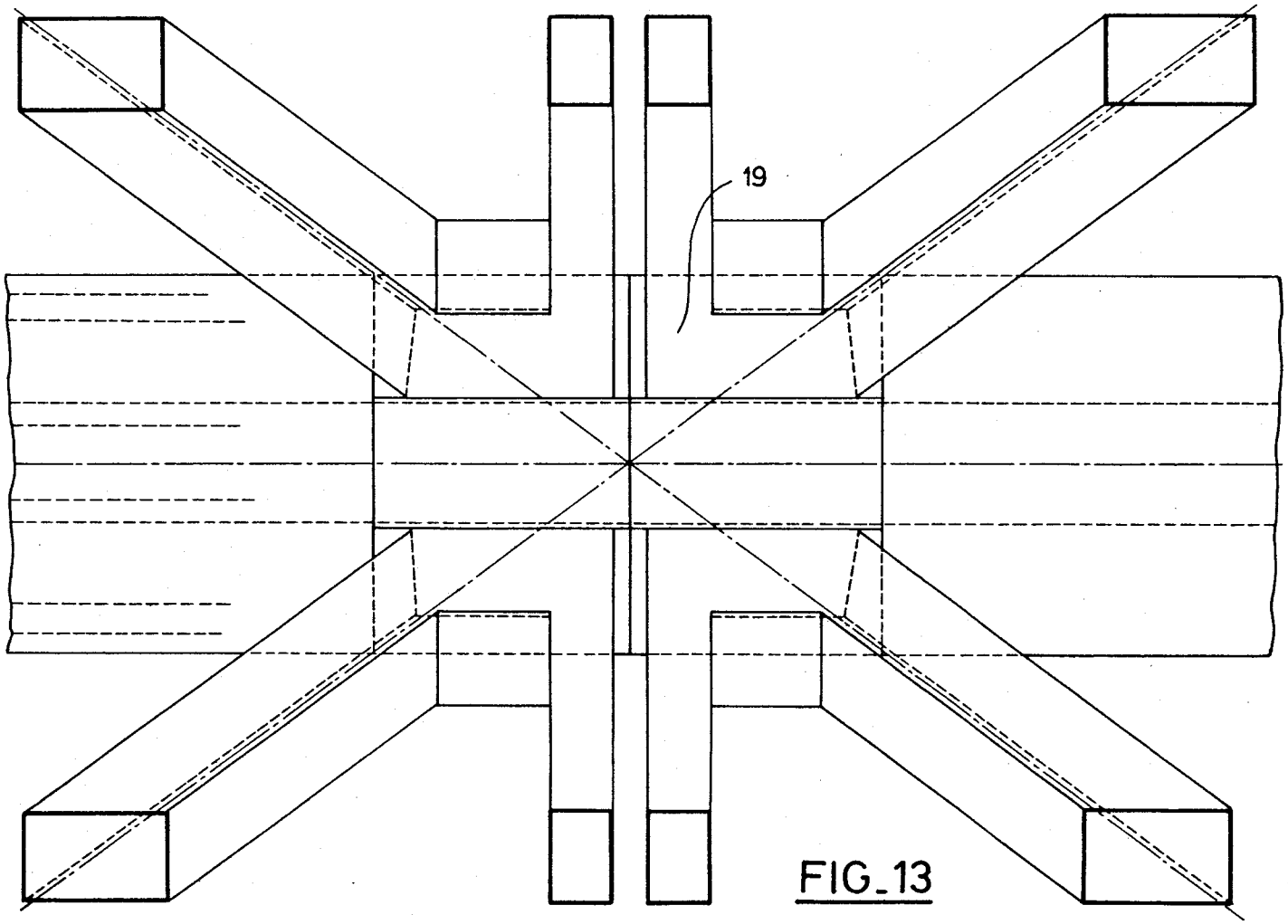
FIGS. 13 and 14 are respectively a top view of a node of the lower table of the floor and a bottom view of a node of the upper table of the floor.
Figure 14:
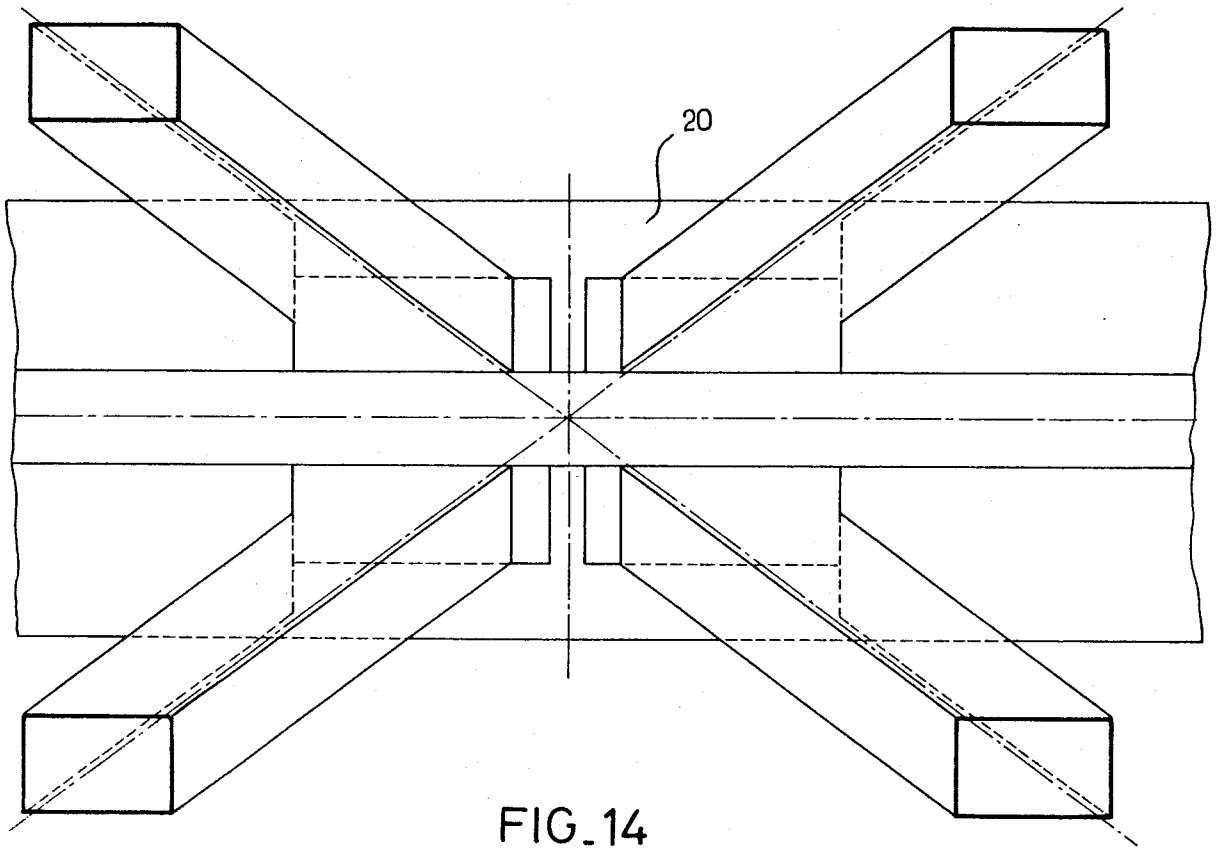

FIGS. 13 and 14 respectively illustrate a node of the lower table in a top view, and a node of the upper table in a bottom view.

Figure 15:
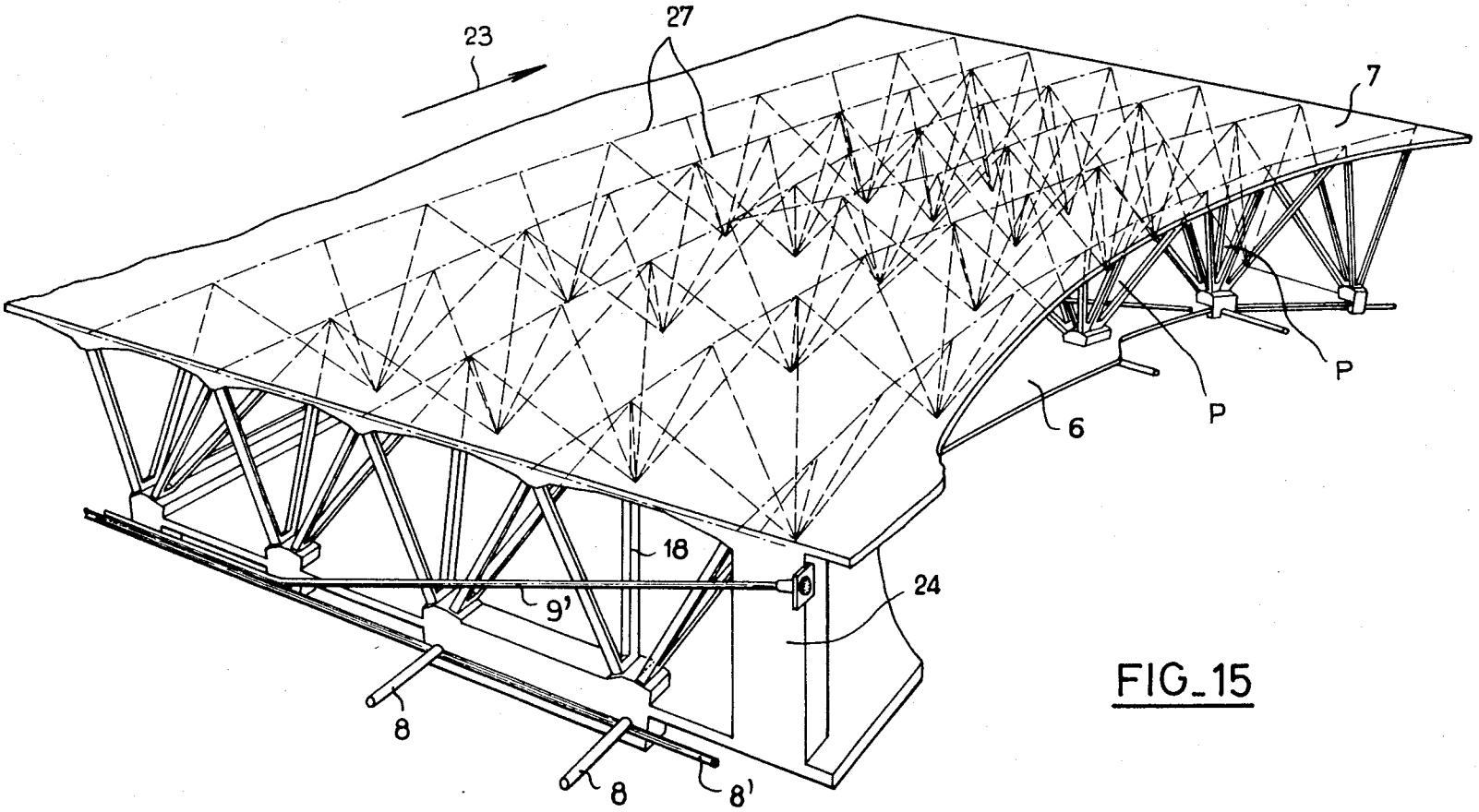
FIG. 15 is a perspective of a portion of the floor.

A schematic perspective of a portion of the floor is illustrated in FIG. 15. In this Figure, arrow 23 indicates the extension direction of the bridge. Some of the characteristics which have been previously described are found again in this Figure, as well as other characteristics which will be mentioned in the following.

Thus, it may be seen in the Figure that the construction also comprises prestressing cables 8' and 9' which extend transversely (whereas the cables 8 and 9 extend longitudinally) and which are anchored in concrete wings or solids masses, such as, for example, the wing 24 positioned between the tables 6 and 7 and being integral therewith. These cross cables, like the longitudinal cables pass outside the concrete of the bars 18 of the triangulation and are deflected at the points of some of the nodes of the lower table.

In a variation, the prestressing cables may pass in the vicinity of the upper table instead of passing in the vicinity of the lower table.

The expression "in the vicinity" is understood to mean that when the cables pass below the lower table or above the upper table, they do not diverge more than a distance equal to a fraction of the distance of the two tables, for example, a distance which is equal to a tenth of a distance between the tables.

In fact, the cables are substantially localised between the tables.

The present invention also relates to a method of constructing the floor of a bridge, as already indicated above.

Figure 16:
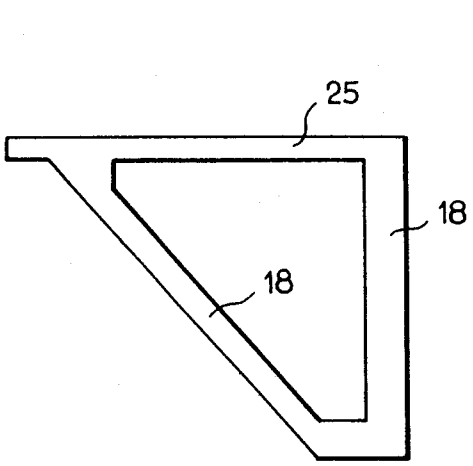
FIG. 16 is a diagram of a lattice work element.

The base element is generally a rigid lattice work element which, in a typical example comprises two bars 18 and a cross piece 25 which are positioned along the three sides of a triangle, as may be seen in FIG. 16.

The following measures are preferred:

- in every section of bar perpendicular to the axis of the bar, the ratio between the largest and the smallest dimension of the section is not greater than 6,
- the bars are from 1 to 10 m long, preferably from 2 to 6 m long,
- the bars have a cross section ranging from 0.004 to 0.5 m2, preferably from 0.02 m2 to 0.2 m2.

The construction which is illustrated also has the following characteristics:

- one of the bars is perpendicular to the cross piece; and the cross piece extends beyond the other bar.

The cross-sectional shape of the bars is immaterial: square, rectangular, oval, etc.

Figure 17:
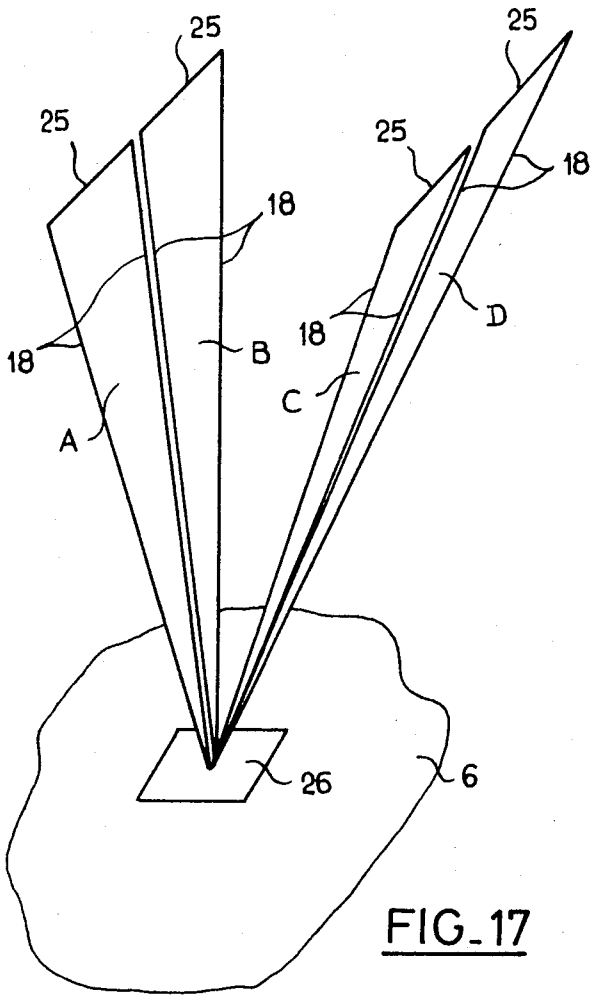
FIG. 17 illustrates the construction method of a movable unit comprising lattice work elements which are integral with a table.

FIG. 17 schematically illustrates the production of a lattice work pyramid using lattice work elements, as described above.

The pyramid comprises four elements A, B, C and D which are positioned so that each lattice work element provides a bar positioned along one of the edges of the pyramid. For this, the four elements A, B, C and D are positioned in pairs in two oblique planes. the meeting points of the bars of the elements converging to form the peak of the pyramid, the two elements of a couple having their two cross pieces 25 aligned and two bars 28 in juxtaposition, the two other bars 18 being positioned along two edges of the pyramid.

The peak of the pyramid is lodged in a reserve 26 of a slab and concrete is cast around the reserve to form a node around this peak and to block the pyramid in position.

During this operation, the lattice work elements are held fast by any suitable means. If necessary, the two couples are and provisionally remain strutted until complete rigidification.

This is not a restrictive manner of producing the nodes.

In practice, several pyramids are thus formed simultaneously on the slab.

It is understood that the pyramid configuration may be obtained using other lattice work elements and that this shape, although preferred, is not restrictive.

These pyramids P are illustrated in FIG. 15, except in the first plane which passes in the median plane of a row of pyramids and which, consequently, only illustrates two elements of each pyramid.

It will be noted that the cross pieces do not intervene in the operation of the lattice work. Their role is to keep the bars in the required arrangement while the construction is being built, and to act as a casing to board the parts of the upper slab which are usually difficult to board.

In FIG. 15, lines 27 have been illustrated which may be formed according to the present invention using cross pieces and which extend over all or part of the length of the construction, which possibly include locations where two cross pieces are joined and which possibly meet other lines. These lines are typical of the present invention.

The prestressing cables may be protected, for example, by a concrete covering which cannot be confused with the concrete of the triangulation.

The present invention allows a considerable saving of concrete to be obtained, possibly as much as 30%, in the construction of a bridge.

Moreover, and this is also very important, the efficiency defined by the ratio between the height of the vertical range where the pressure line has to pass (due to the prestress, to the weight of the structure and to the working loads) and the complete height of the structure (i.e., the height of the hollowed out slab) may reach 0.65 to 0.95, according to the teachings of this invention, instead of remaining within the range of from 0.35 to 0.55, obtained by conventional methods.

I claim:

1. A prestressed concrete structure behaving like a hollowed out slab, comprising two reinforced or prestressed concrete slabs which are positioned opposite each other in generally parallel spaced relationship and which are connected by a lattice work of concrete bars positioned in and across the space between the slabs, the lattice work being mainly composed of a plurality of prefabricated concrete triangle elements, each triangle element comprising at least one group of at least two bars and at least one cross piece positioned generally along the three sides of a triangle, the meeting point of the two bars forming the apex of the triangle and being adjacent one of said slabs and the cross piece being parallel to and adjacent the other of said slabs, a plurality of cables for prestressing the whole of the structure, and at least two concrete cable anchor members which are spaced apart longitudinally and positioned between and extend across the space between the two slabs and which are integral with at least one of the slabs, said cables extending generally longitudinally between said anchor members and having opposite end portions anchored respectively therein, and each of said cables extending from and adjacent each of its said anchored end portions in the space between said slabs first angularly toward its other end portion and angularly toward one of said slabs, then angularly in free passage through said one slab, and finally in parallel adjacent relationship with said one slab and on an opposite side thereof to its said opposite end portion, and each of said cables adjacent its anchored end portions also passing angularly in free, unconnected and unobstructed passage through said space and the lattice work between said slabs.

2. A structure according to claim 1, wherein said lattice work comprises pyramids, each pyramid comprising four said prefabricated elements positioned in pairs in two oblique planes, the meeting points of the bars of the elements converging to form the peak of the pyramid, two elements of a pair of said elements having their two cross pieces aligned and two bars in juxtaposition, the two other bars being positioned along two edges of the pyramid.

3. A structure according to claim 1, characterized in that the area of concrete which is in a section of said space by a median plane which is substantially parallel to the said upper and lower slabs is provided to at least 50% by the bars of the lattice.

4. A structure according to claim 1, characterized in that the prestressing cables undergo deflections in nodes formed on the slabs opposite the apexes of the bars of the lattice work.

5. A structure according to claim 1, characterized in that grooves are provided in at least one of the slabs for guiding the passage of the prestressing cables.

6. A structure according to claim 1, characterized in that some of the anchor member comprise vertical slabs in which some of the prestressing cables pass.

7. A structure according to claim 6, characterized in that some anchor member comprise, on both sides of this vertical slab, oblique slabs which participate in transmitting the anchoring strain of the cables to the structure and produce a triangulation of forces.

8. A structure according to claim 1, characterized in that the prestressing cables comprise both longitudinal and transverse cables.

9. A structure according to claim 1 characterized in that within each lattice work bar section perpendicular to the axis of the bar, the ratio between the largest and the smallest dimension of the section is not greater than 6.

10. A structure according to claim 1 characterized in that the bars of the lattice work are from 1 to 10 m long, preferably from 2 to 6 m long.

11. A structure according to claim 1, characterized in that the bars of the lattice work have a cross section of from 0.004 to 0.5 m2, preferably from 0.02 m2 to 0.2 m2.

12. A structure according to claim 1, characterizied in that the lower slab and upper slab are solid.

13. A structure according to claim 1, characterized in that the said cross-piece of a concrete triangle element of the lattice is at right angle with respect to one of the bars of said element.

14. A structure according to claim 13, characterized in that the cross piece extends beyond the meeting point thereof with one of the bars.

15. A structure according to claim 1, characterized in that some of the cross pieces of the lattice work elements are positioned along a line which extends over part or all of the length of a slab.

16. A structure according to claim 1 characterized in that portions of said cables reside adjacent said one slab in positions opposite the apexes of at least some of said triangle elements which are also adjacent said one slab but on an opposite side thereof.

* * * * *